US010239737B1

(12) United States Patent
Nickerson, III

(10) Patent No.: US 10,239,737 B1
(45) Date of Patent: Mar. 26, 2019

(54) MODULAR AUTOMOBILE LIFT

(71) Applicant: Richard E. Nickerson, III, Plainville, MA (US)

(72) Inventor: Richard E. Nickerson, III, Plainville, MA (US)

( * ) Notice: Subject to any disclaimer, the term of this patent is extended or adjusted under 35 U.S.C. 154(b) by 227 days.

(21) Appl. No.: 15/263,903

(22) Filed: Sep. 13, 2016

(51) Int. Cl.
*B66F 7/20* (2006.01)

(52) U.S. Cl.
CPC ..... *B66F 7/20* (2013.01); *B66F 2700/123* (2013.01)

(58) Field of Classification Search
CPC ..... B65G 69/30; B66F 2700/12; B66F 2700/123; B66F 7/06; B66F 7/10–7/16; B66F 7/20
See application file for complete search history.

(56) References Cited

U.S. PATENT DOCUMENTS 4,501,342 A * 2/1985 Murphy ..... B66F 7/28 187/216
4,845,974 A * 7/1989 Bergstrom ..... B21D 1/14 187/211
2003/0178610 A1* 9/2003 Finkbeiner ..... B66F 7/0691 254/90
2006/0043350 A1* 3/2006 Branstetter ..... B66F 7/243 254/88
2008/0156589 A1* 7/2008 Marchand ..... B66F 7/065 187/219
2009/0277723 A1* 11/2009 Straub ..... B66F 7/28 187/216
2009/0321189 A1* 12/2009 Schmitt ..... B66F 7/04 187/215
2015/0368077 A1* 12/2015 Liu ..... B25H 1/0007 187/216

FOREIGN PATENT DOCUMENTS

FR 1260796 A * 5/1961 ..... B66F 7/28
GB 2040461 A * 8/1980 ..... B66F 7/02

* cited by examiner

*Primary Examiner* — Tyrone V Hall, Jr.
(74) *Attorney, Agent, or Firm* — Salter & Michaelson

(57) ABSTRACT

A modular automobile lift is arranged in a compact bundle for the purpose of transportation of the modular automobile lift to a lift assembly site. The modular automobile lift includes a pair of separate runways meant ultimately for the support of an automobile and a pair of cross beams meant ultimately for the lifting of the pair of runways by means of lift columns. Each runway is constructed and arranged in separate runway segments and meant to be connected together at the lift assembly site. The bundle further includes at least a mounting member with each runway being formed at the lift assembly site by securing the separate runway segments in series by means of the mounting member.

11 Claims, 12 Drawing Sheets

MODULAR AUTOMOBILE LIFT

FIELD OF THE INVENTION

The present invention relates in general to a modular form of an automobile lift, and pertains more particularly to a bundle or packaging concept as it relates to the transportation of a lift bundle that enables easier transportation of the bundle or package. Even more particularly the present invention relates to a lift bundle or package that enables easier transportation of the bundle or package without requiring expensive special purpose equipment.

BACKGROUND OF THE INVENTION

At the present time in the installation of an automotive lift, particularly for personal or non-commercial use, special equipment is needed such as a fork lift or similar piece of equipment in order to handle the rather cumbersome package being transported. Typically, the entire lift mechanism is crated or otherwise packaged in what might be referred to as a bundle. This package contains all the components necessary in subsequently assembling the automotive lift at a lift assembly site, such as in ones garage or shop. One of the problems associated with this transportation to the lift assembly site is due to the fact that certain main components are quite long and thus special equipment is required. One main component is the runways that form part of the package.

Accordingly, it is an object of the present invention to provide an improved way of transporting the modular automobile lift package.

Another object of the present invention to provide an improved modular automobile lift package in which particularly the runways are separated into runway segments so that the package is effectively cut in half or more.

Still another object of the present invention to provide an improved modular automobile lift package in which cross beams within the package are separated into separate cross beam segments so as to shorten the length of the package.

A further object of the present invention to provide an improved modular automobile lift package in which additional components are provided as part of the package in order to secure the separate parts upon assembly at the lift assembly site. These additional components include a mounting member for connecting the separate runway segments and a connector member for connecting the separate cross beam segments.

Another object of the present invention is to provide an improved modular package for assembling an automobile lift which has been substantially shortened in length so that the package can be handled more effectively particularly without requiring the use of special purpose equipment in order to unload the package at the lift assembly site. For example, in accordance with the present invention because of the use of a multi runway segment mounting member the assembled bundle or package can be delivered by a pickup truck on a lift gate of the truck.

SUMMARY OF THE INVENTION

To accomplish the foregoing and other objects, features and advantages of the present invention there is provided a modular automobile lift that is arranged in a compact bundle for the purpose of transportation of the modular automobile lift to a lift assembly site. The modular automobile lift includes a pair of separate runways meant ultimately for the support of an automobile and a pair of cross beams meant ultimately for the lifting of the pair of runways by means of lift columns. Each runway is constructed and arranged in separate runway segments and meant to be connected together at the lift assembly site. The bundle further includes a mounting member. Each runway is formed at the lift assembly site by securing the separate runway segments in series by means of the mounting member.

In accordance with other aspects of the present invention each separate runway segment extends longitudinally having a length greater than its width; the number of separate runway segments is at least two; the at least two separate runway segments are of substantially the same length; the mounting member comprises a channel member; including fasteners for securing the channel member between adjacently disposed runway segments so that the runway segments form a continuous runway without any gap between the runway segments; each channel member is disposed at a side of the runway segment; one on each side of the assembled runway segments; further including a connector member; wherein each cross beam constructed and arranged in separate cross beam segments and meant to be connected together at the lift assembly site; wherein each cross beam is formed at the lift assembly site by securing the separate cross beam segments in series by means of the connector member; and including fasteners for securing the connector member between adjacently disposed cross beam segments so that the cross beam segments form a continuous cross beam without any gap between the cross beam segments.

In accordance with another version of the present invention there is provided a method of constructing a modular automobile lift by initially arranging components of the automobile lift in a bundle ready for transportation, providing as part of the bundle a pair of runways with each runway constructed and arranged in separate runway segments, providing a mounting member, transporting the bundle to a lift assembly site, and re-assembling the separate runway segments at the lift assembly site by securing the separate runway segments in series by means of the mounting member.

In accordance with other aspects of the method of the present invention providing fasteners as part of the bundle and for securing together the separate runway segments; providing fasteners as part of the bundle for securing the mounting member between adjacently disposed runway segments so that the runway segments form a continuous runway without any gap between the runway segments; providing each cross beam constructed and arranged in separate cross beam segments and a connector member; and wherein the separate cross beam segments are meant to be connected together at the lift assembly site by means of the connector member.

In accordance with another version of the present invention there is provided a modular automobile lift bundle that is particularly formed in a length for ready transportation of the modular automobile lift from a bundling site to a lift assembly site. The modular automobile lift bundle includes a pair of separate runways meant ultimately for the support of an automobile and a pair of cross beams meant ultimately for the lifting of the pair of runways by means of lift columns. Each runway is constructed and arranged in separate runway segments and meant to be connected together at the lift assembly site. The bundle further includes a mounting member. Each runway is formed at the lift assembly site by securing the separate runway segments in series by means of the mounting member.

In accordance with still other aspects of the present invention there is provided including a connector member and wherein each cross beam is constructed and arranged in separate cross beam segments and meant to be connected together at the lift assembly site; and including fasteners for securing the mounting member between adjacently disposed runway segments so that the runway segments form a continuous runway without any gap between the runway segments, and fasteners for securing the connector member between adjacently disposed cross beam segments so that the cross beam segments form a continuous cross beam without any gap between the cross beam segments.

BRIEF DESCRIPTION OF THE DRAWING

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
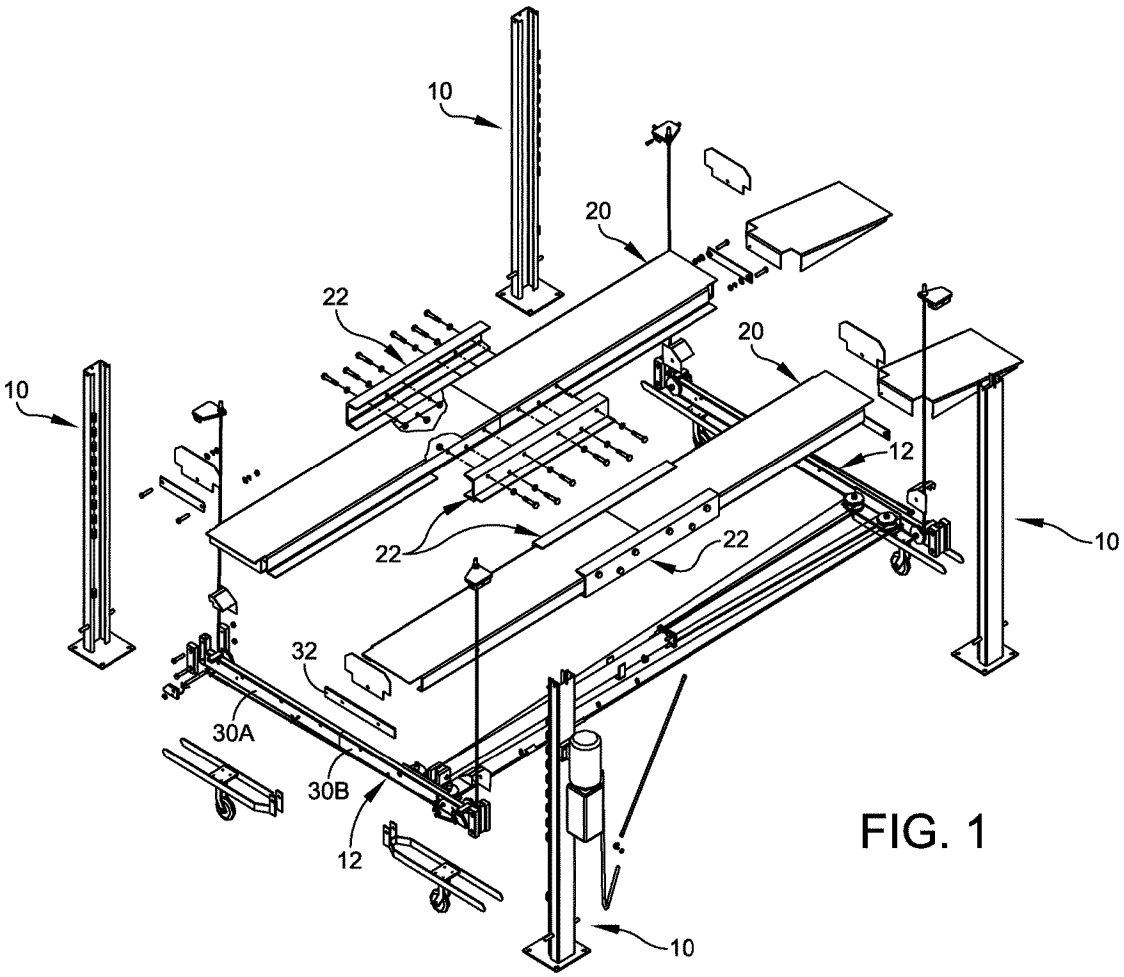
FIG. 1 is an exploded perspective view of the modular automobile lift of the present invention illustrating the various components that comprise a finally assembled lift.

Reference is now made to the drawings for an illustration of the concepts of the present invention. FIG. 1 in particular is an exploded perspective view of an entire assembly of all components used in constructing the final lift. Because many of the main components are presently known they will not be described herein in detail. The present description is aimed at certain modifications that enable an easier transport of the bundle of components from an assembly site where the components are prepared for shipping to a set-up or re-assembly site where the lift is set up for final use. The term used herein for the assembly of all components is "bundle" or "package".

The main components shown in FIG. 1 include four lift columns 10, cross beams 12 and runways 20. Mechanisms are associated with these components that control the lift and which may include mechanical components such as cabling and electrical components. Also included are the cross beams 12 that interconnect pairs of lift columns 10 and that connect with the parallel runways used in lifting the vehicle. The vehicle is meant to be driven onto the runways and then lifted via actions at the lift columns, which in turn lift the respective cross beams and runways in unison.

Figure 12:
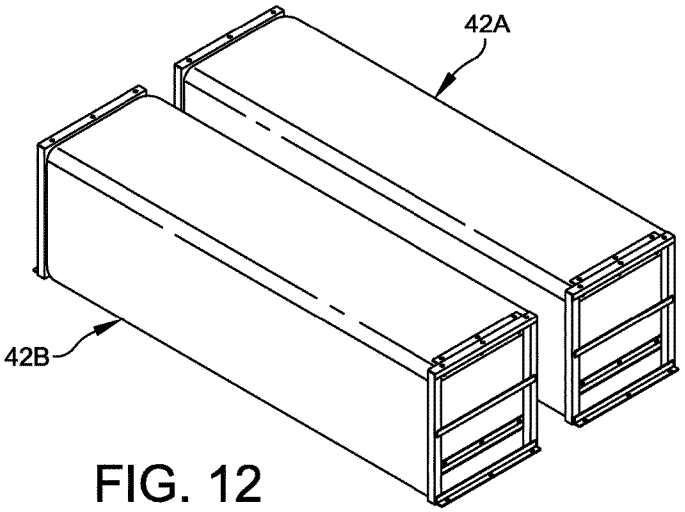
FIG. 12 is a schematic illustration showing the reduced length of the package when using the segmented runway.
Figure 13:
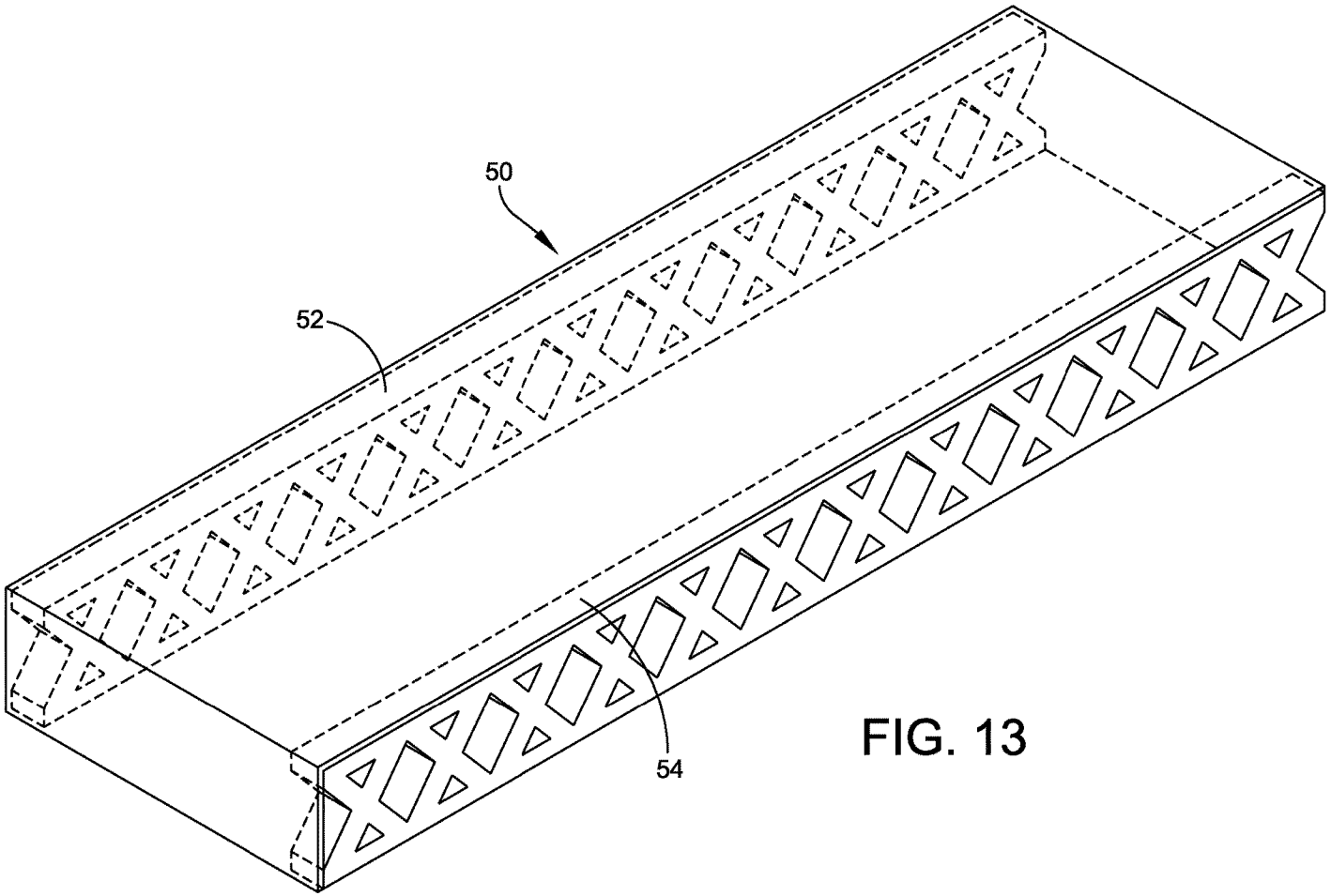
FIG. 13 is a perspective but schematic view of an alternate construction of the runway.
Figure 14:
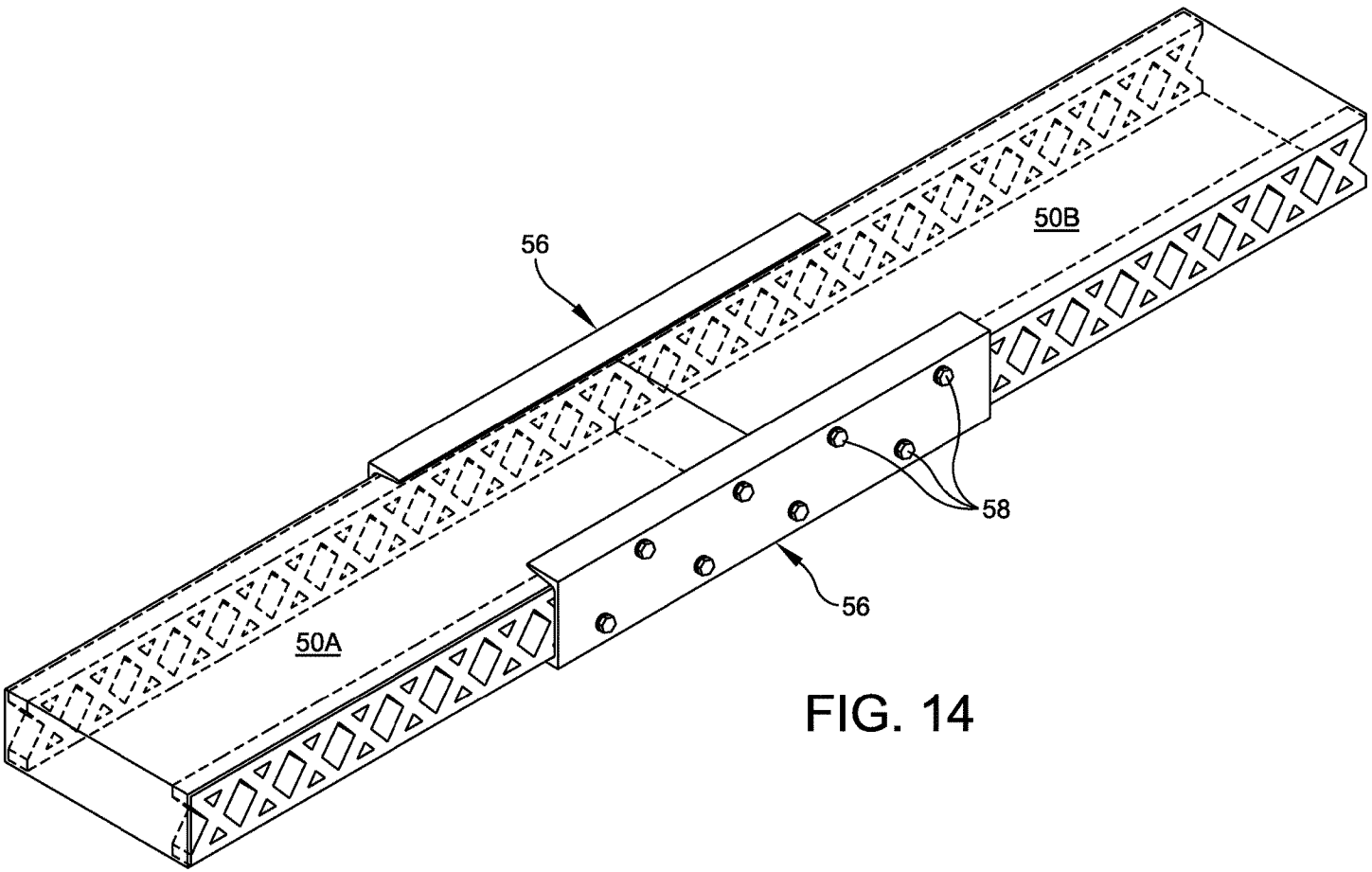
FIG. 14 is a perspective but schematic view of the runway construction of FIG. 13 with the use of a pair of mounting channels on opposed sides of the runway.

As indicated previously FIG. 1 shows the complete lift assembly. FIGS. 2-11 describe one embodiment of the present invention. FIGS. 12 and 13 are meant to illustrate how certain components are packaged to have a shorter length. This makes the transportation of the package or bundle far easier without requiring complex special equipment such as a fork lift. FIGS. 13 and 14 describe another embodiment of the present invention regarding a particular construction of the runways that is considered as stronger in its structure.

With regard to the embodiment of the present invention illustrated in FIGS. 2-11, it is noted that the modular automobile lift can be arranged in a compact bundle for the purpose of transportation of the modular automotive lift to a setup or reassembly site. In this regard, FIG. 11 at 40 shows the substantial length of the bundle that has been previously required, thus requiring the use of a piece of special equipment such as a forklift. On the other hand, reference may be made to FIG. 12 that shows two shorter length bundles 42A, 42B. Because of the shorter length of these bundles, the assembled bundle or package can be delivered more easily such as by using a conventional pickup truck or other vehicle with a lift gate. The modular automobile lift is comprised of several components as illustrated in FIG. 1 and includes a pair of separate runways meant ultimately for the support of a vehicle, and a pair of cross beams meant ultimately for the lifting of the pair of runways by means of the lift columns 10.

Figure 2:
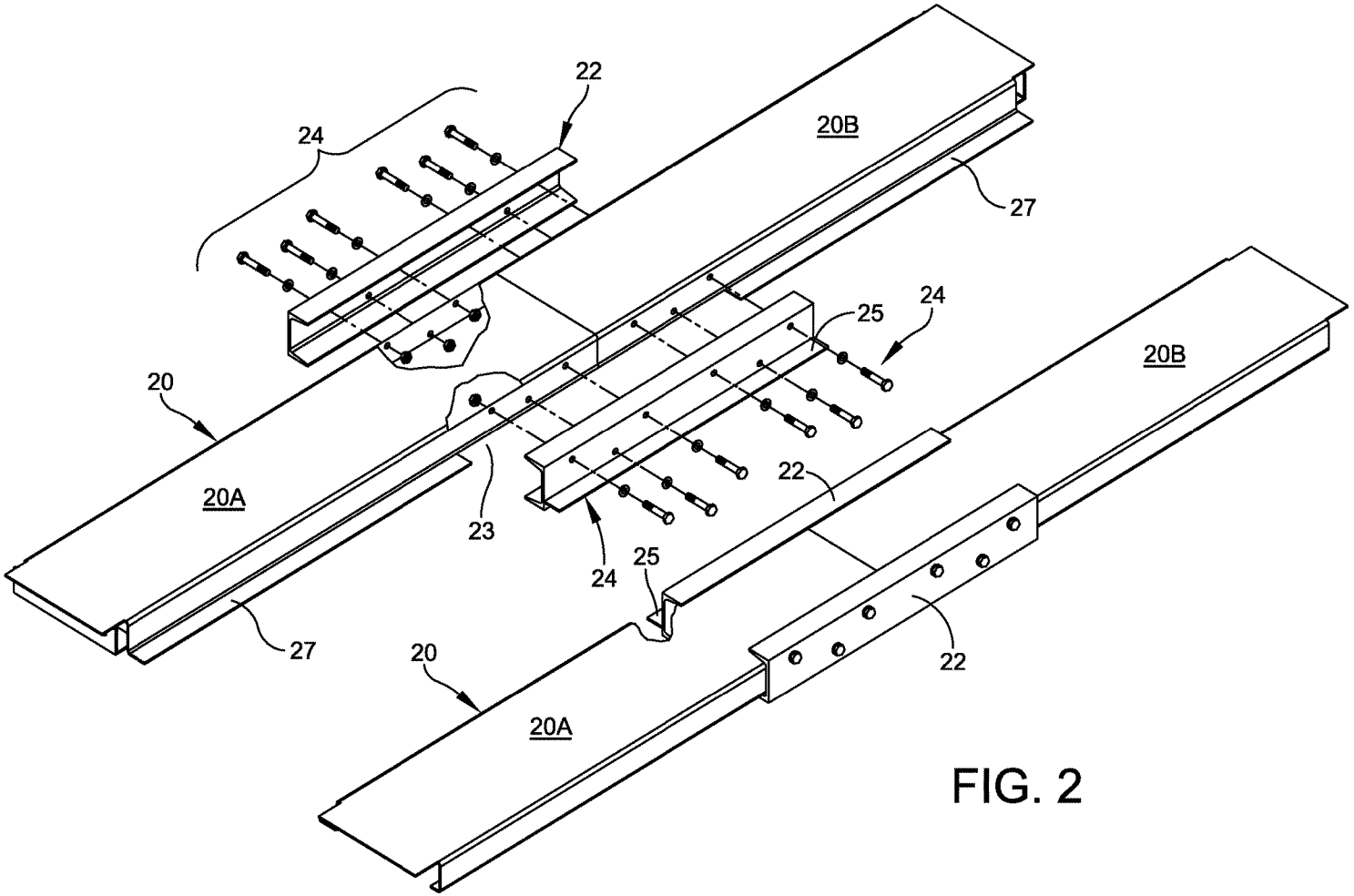
FIG. 2 is a fragmentary perspective view showing the mounting member used in attaching the separate runway segments.
Figure 3:
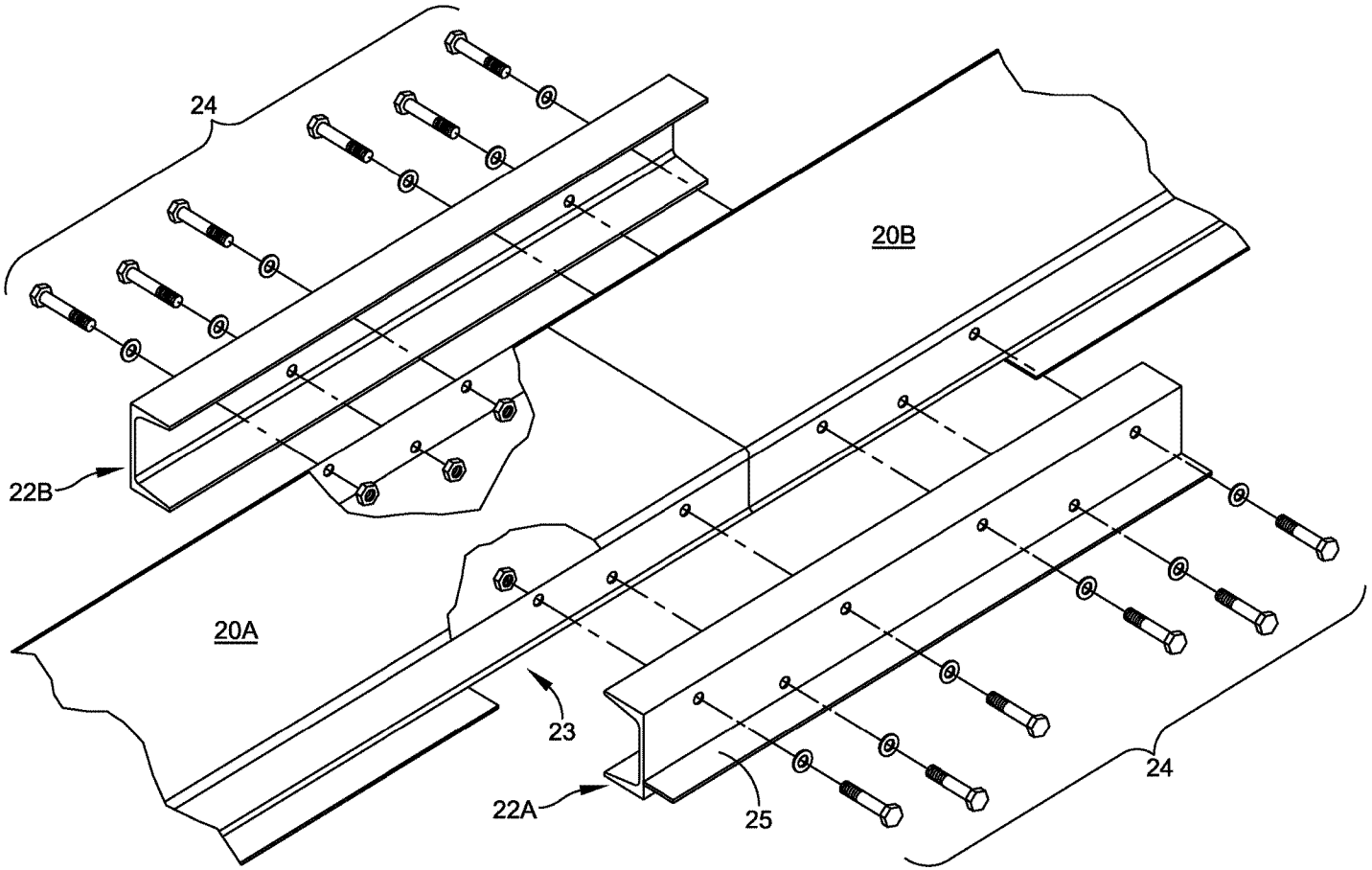
FIG. 3 is a fragmentary perspective view of one of the assembled runways and also illustrating the use of fasteners.

Reference may now be made to FIGS. 2 and 3 which illustrates that each runway 20 is constructed and arranged in separate runway segments 20A, 20B. FIGS. 2 and 3 illustrate these segments 20A, 20B as being connected together at an initial assembly site by means of the mounting members 22. The segments 20A, 20B may be originally constructed as separate segments or an existing runway may be cut in half to form the separate runway segments as illustrated. Thus, the runway segments are essentially reassembled at the final use site by securing the separate runway segments in series by means of a mounting member.

As illustrated in FIG. 3, these mounting members may be considered as comprised of a mounting member 22A and a mounting member 22B that are of similar construction. However, the mounting member 22A is provided with a lip 25. This lip 25 is also shown in FIG. 1 in the mounting members. Each mounting member is illustrated as formed basically as a U-shaped channel with the opening of the channel resting against respective sides of the runway segments. It is preferred that the lip 25 on the respective mounting members 22A be in a facing relationship. This lip 25 associated with each runway can then be used as a mounting surface such as a surface for mounting a tool box arrangement. FIGS. 2 and 3 also illustrate fasteners at 24 which may be comprised of a bolt, nut, regular washer and lock washer. FIG. 2 in particular shows two of the mounting members 22 secured in place as well as the other pair of mounting members exploded away from the runway. Also illustrated in FIG. 2 is a cutout at 23. This cutout is in a further lip 27. Each of the mounting members 22 is meant to fit within the cutout or recess 23.

Figure 4:
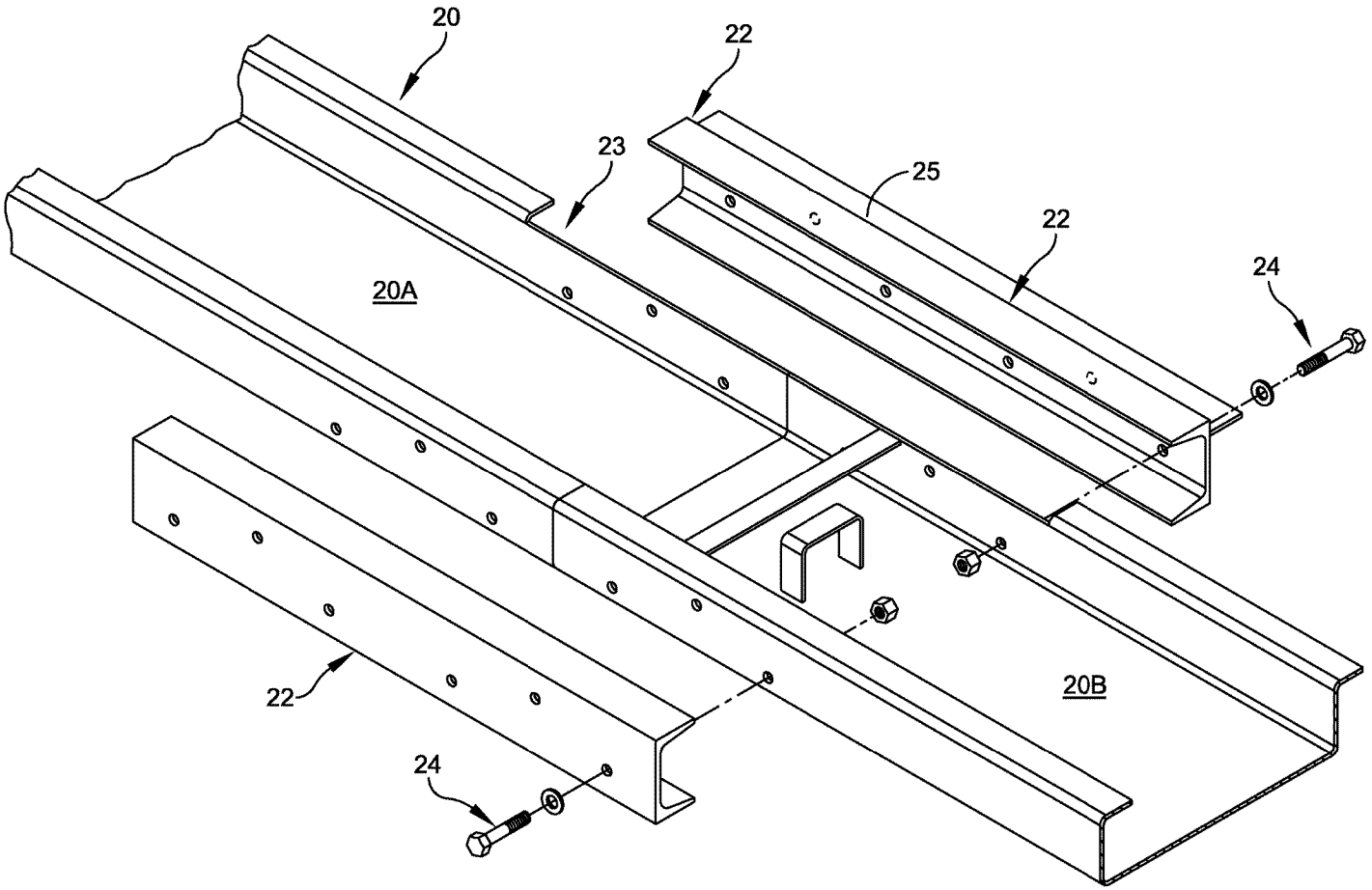
FIG. 4 is an enlarged perspective view of the underside of the attached runway segments.
Figure 5:
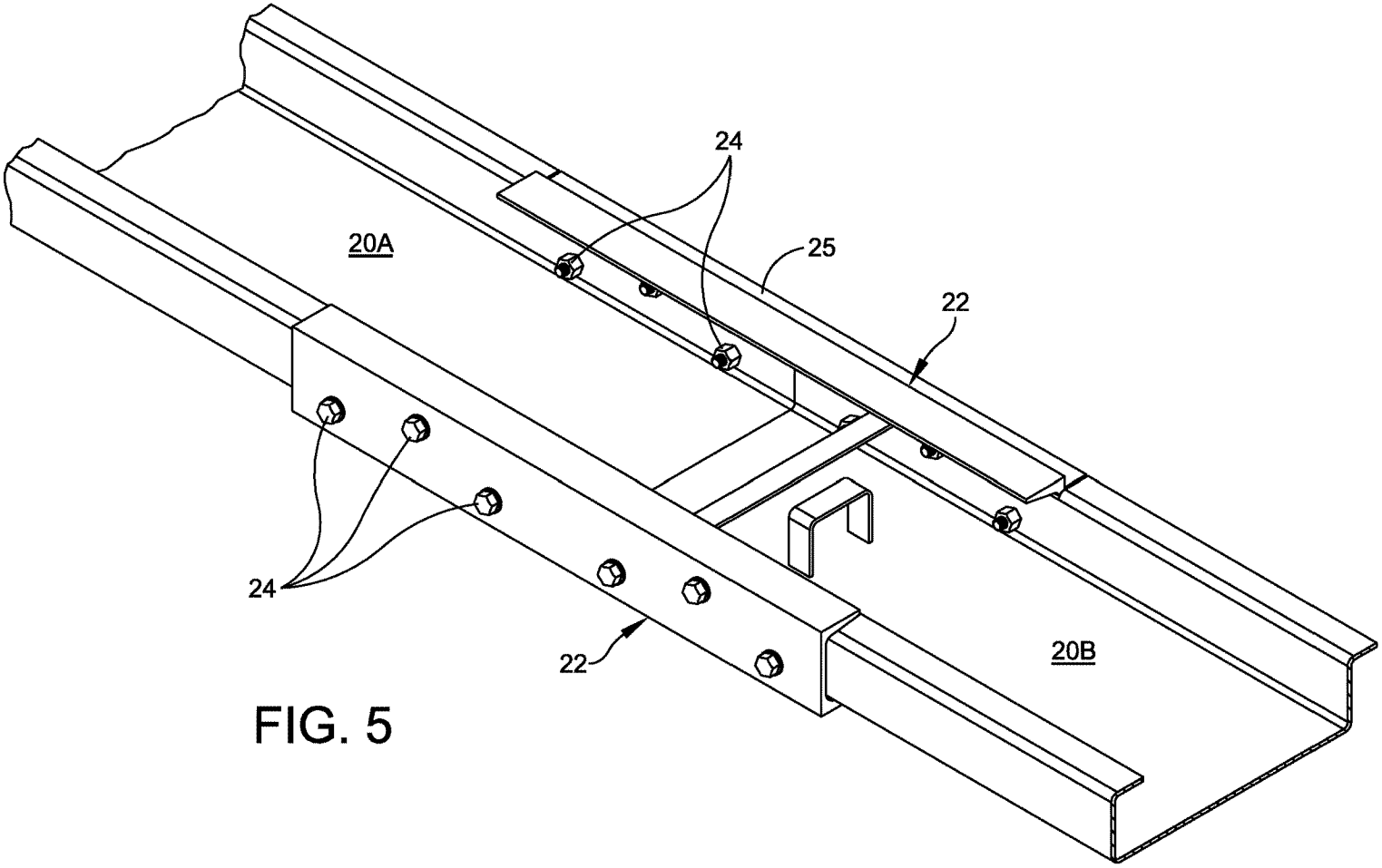
FIG. 5 is a perspective view illustrating the runway segments in a completely attached condition using opposed mounting members in the form of respective channel members.
Figure 6:
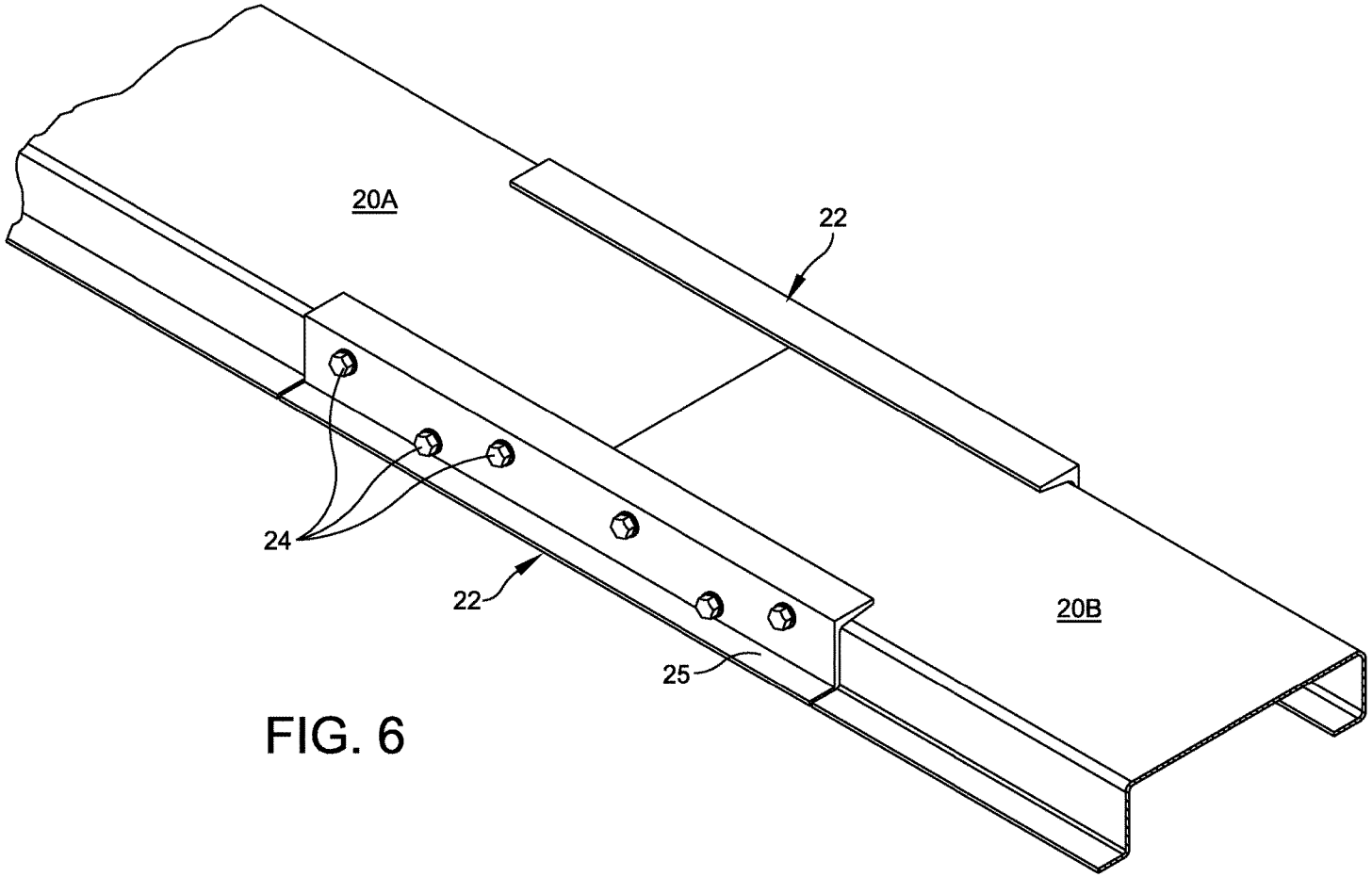
FIG. 6 is a fragmentary perspective view taken from the opposite side.
Figure 7:
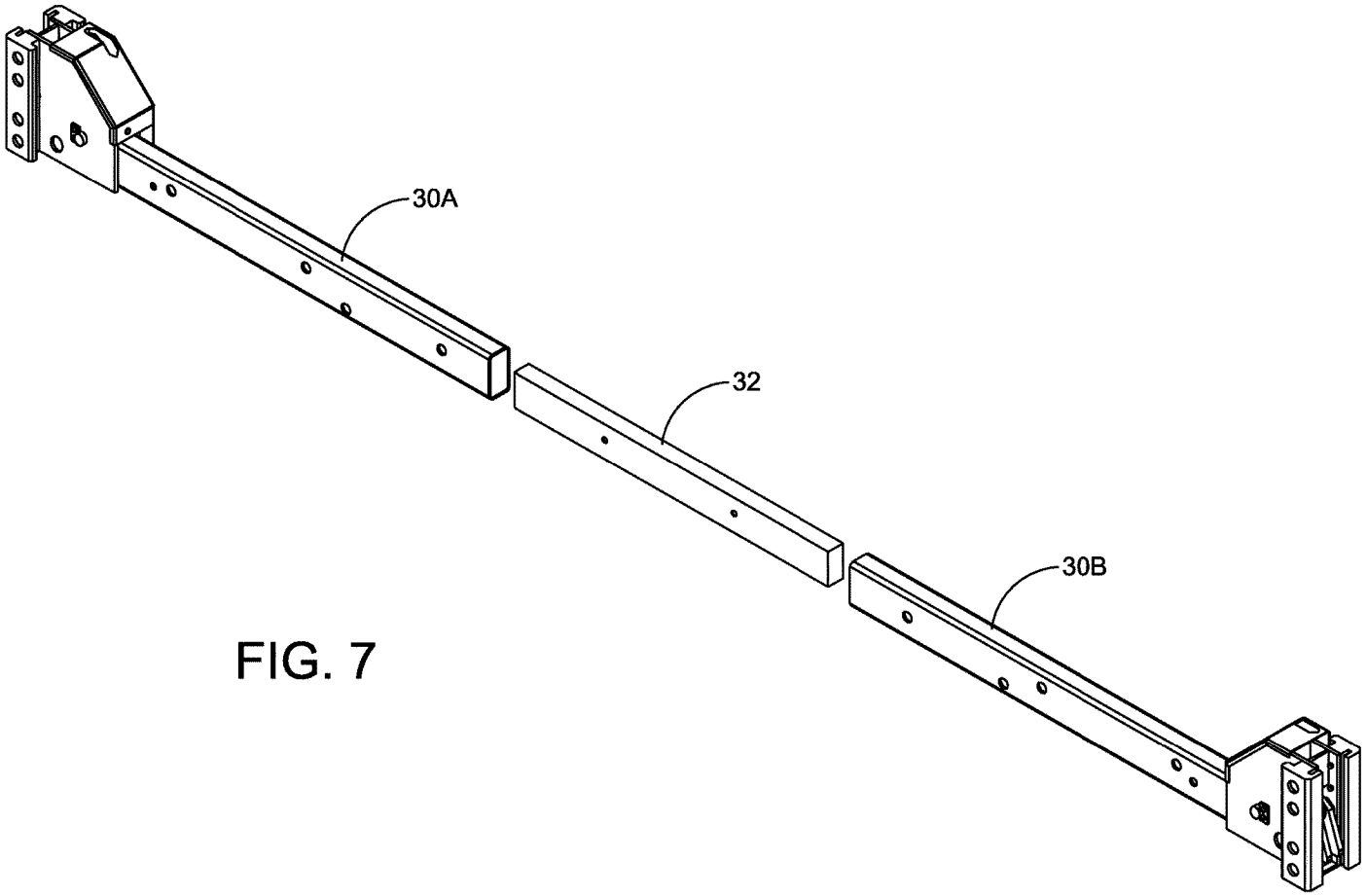
FIG. 7 is a perspective view of the cross beam as including separate cross beam segments attached by means of a single connector member.

Reference is now made to FIGS. 5 and 6 which show an underside to the segment 20A, 20B. Also illustrated are the mounting members 22 one of which is provided with the lip 25. FIGS. 4 and 5 also illustrate fasteners at 24 which may including a bolt, nut, regular washer and lock washer. FIG. 4 also illustrates the aforementioned cutout at 23. FIG. 5 illustrates the mounting members 22 as in position. FIG. 6 is a further fragmentary perspective view on the opposed side of the runway to that shown in FIG. 3 and also illustrating the lip at 25. The lip 25 is in a position facing the lip 25 of the opposed runway mounting member.

Figure 8:
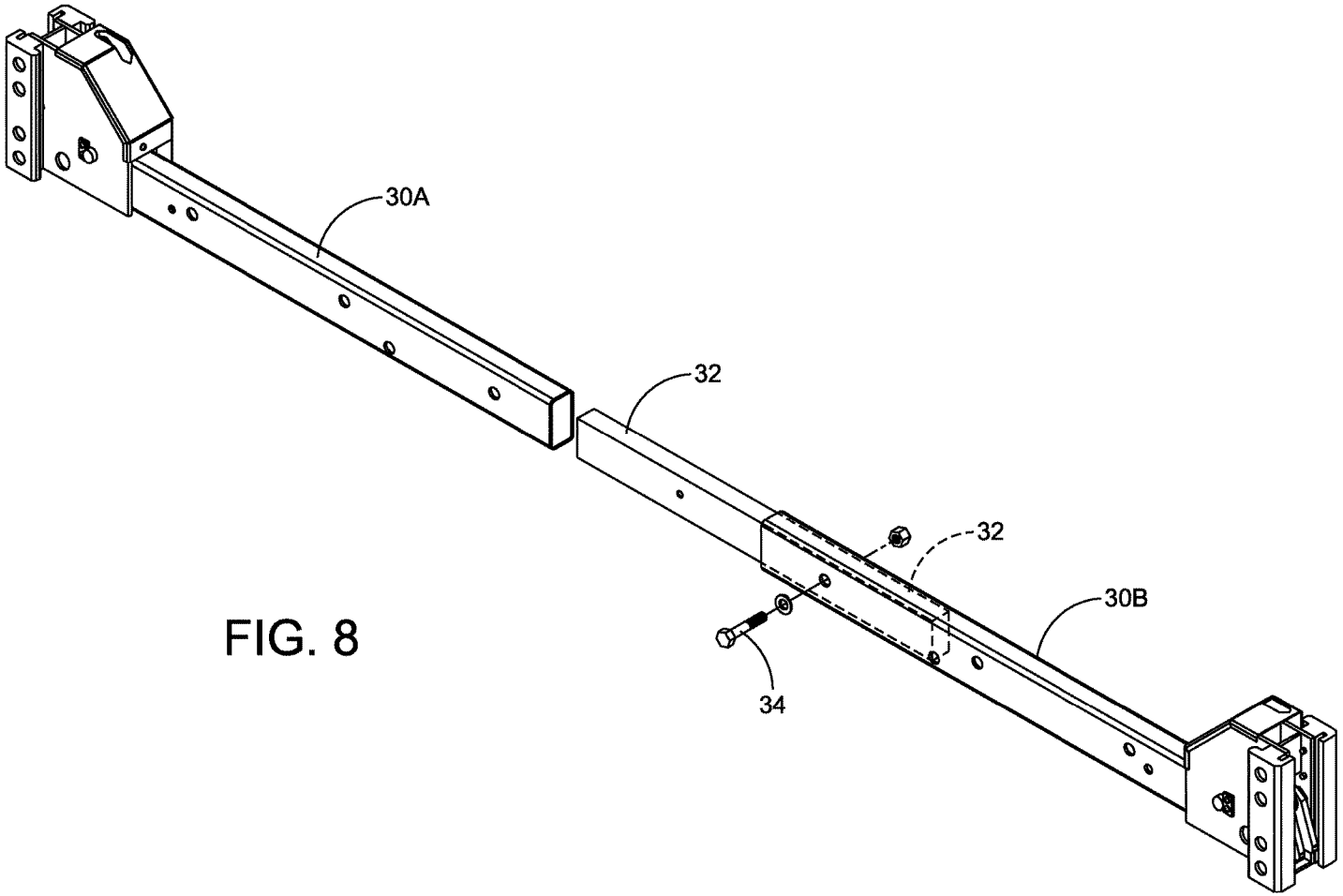
FIG. 8 is a perspective view like that shown in FIG. 7 with the connector member illustrated as secured within one of the cross beam segments.
Figures 9, 10:
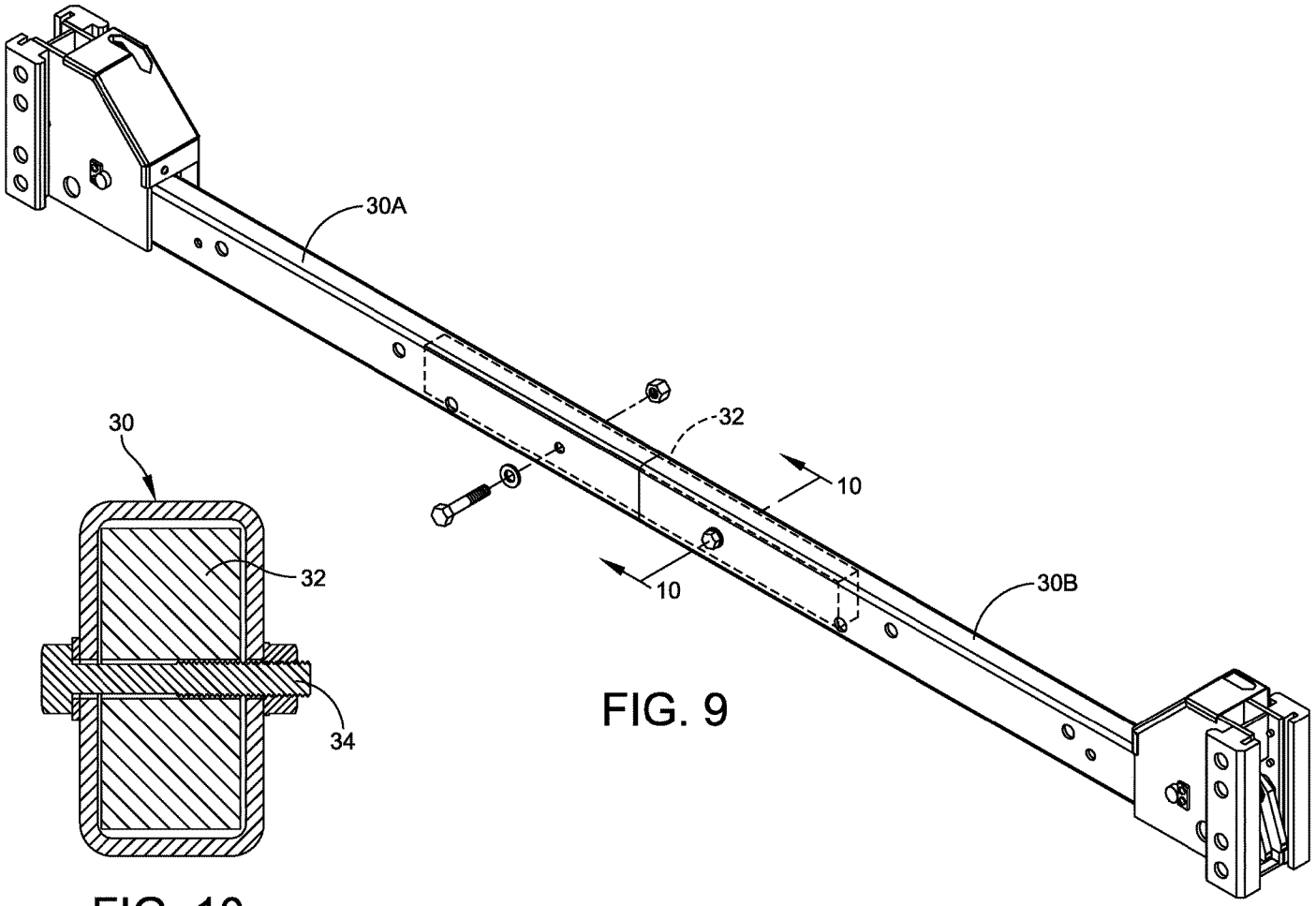
FIG. 9 is a perspective view like that illustrated in FIGS. 7 and 8 but fully assembled by means of the connector member.
FIG. 10 is a cross-sectional view taken along line 10-10 of FIG. 9.
Figure 11:
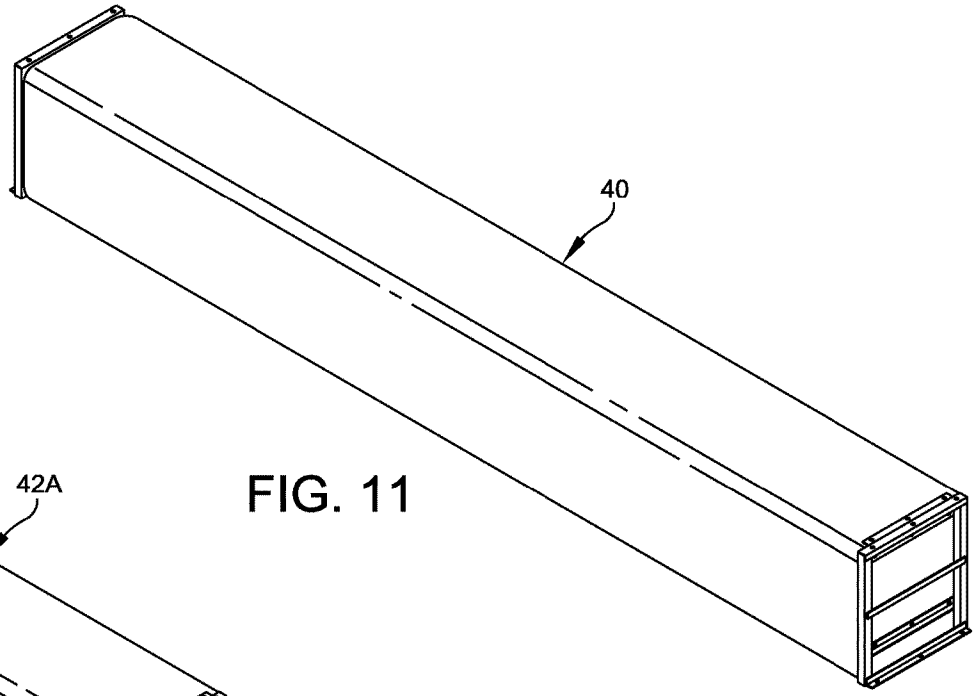
FIG. 11 is a schematic illustration showing the length of the package when using a typical runway.

The other main component that is modified in accordance with the present invention is the cross beam 12 illustrated in FIG. 1. As illustrated in FIGS. 7-10, the cross beam is cut at about its middle location (or can be originally formed in segments) and is thus constructed and arranged in separate cross beam segments 30A, 30B that are meant to be connected together at the final assembly site. The cross beam is finally formed at the final assembly site by securing the separate cross beam segments 30A, 30B in series by means of the opposed position connector members 32. Connector member 32 may be a solid rectangular metal piece having holes for receiving fasteners illustrated at 34 in FIG. 8. Of course, there are several fasteners that are used disposed at intervals along each of the cross beam segments. These fasteners may be in the form of a bolt, nut, regular washer and lockwasher. As illustrated in the cross-sectional view of FIG. 10, one of the fasteners 34 passes through opposed walls defining the cross beam segment and through the connector member 32. As also illustrated in FIGS. 8 and 9, the cross beam segments 30A, 30B are both hollow so as to receive the inner disposed connector member 32. In an alternate embodiment of the present invention, in place of the connector member 32 as illustrated, a pair of side plates may be provided on opposite sides of the respective cross beam segments.

Reference is also now made to a different version of the present invention illustrated in FIGS. 13 and 14. This provides sidewalls 52 and 54 that are in the form of a truss. This embodiment also employs opposed mounting members 56 and uses fasteners 58 as illustrated in FIG. 14. The mounting members 56 interconnect runway segments 50A and 50B.

In accordance with other features of the present invention each separate runway segment extends longitudinally having a length greater than its width; the number of separate runway segments is at least two and may comprises greater than two thus shortening the bundle even further; the at least two separate runway segments may be of substantially the same length; the mounting member comprises a channel member; including fasteners for securing the channel member between adjacently disposed runway segments so that the runway segments form a continuous runway without any gap between the runway segments; wherein each channel member is disposed at a side of the runway segment; one on each side of the assembled runway segments; further including a connector member; wherein each cross beam constructed and arranged in separate cross beam segments and meant to be connected together at the lift assembly site; and wherein each cross beam is formed at the lift assembly site by securing the separate cross beam segments in series by means of the connector member; and including fasteners for securing the connector member between adjacently disposed cross beam segments so that the cross beam segments form a continuous cross beam without any gap between the cross beam segments.

In accordance with the present invention a further feature is a method of constructing a modular automobile lift by initially arranging components of the automobile lift in a bundle ready for transportation, providing as part of the bundle a pair of runways with each runway constructed and arranged in separate runway segments, providing a mounting member, transporting the bundle to a lift assembly site, and re-assembling the separate runway segments at the lift assembly site by securing the separate runway segments in series by means of the mounting member.

Other features include providing fasteners as part of the bundle and for securing together the separate runway segments; providing fasteners as part of the bundle for securing the mounting member between adjacently disposed runway segments so that the runway segments form a continuous runway without any gap between the runway segments; providing each cross beam constructed and arranged in separate cross beam segments and a connector member; and providing the connector member to connect together the separate cross beam segments at the lift re-assembly site.

A further feature of the present invention is a modular automobile lift bundle that is particularly formed in a length for ready transportation of the modular automobile lift from a bundling site to a lift re-assembly site. The modular automobile lift bundle includes a pair of separate runways meant ultimately for the support of an automobile and a pair of cross beams meant ultimately for the lifting of the pair of runways by means of lift columns. Each runway is constructed and arranged in separate runway segments and meant to be connected together at the lift assembly site, a mounting member, and each runway being formed at the lift re-assembly site by securing the separate runway segments in series by means of the mounting member. The lift bundle also includes a connector member and wherein each cross beam is constructed and arranged in separate cross beam segments and meant to be connected together at the lift assembly site. Fasteners are provided for securing the mounting member between adjacently disposed runway segments so that the runway segments form a continuous runway without any gap between the runway segments, along with fasteners for securing the connector member between adjacently disposed cross beam segments so that the cross beam segments form a continuous cross beam without any gap between the cross beam segments.

Having now described a limited number of embodiments of the present invention, it should now be apparent to those skilled in the art that numerous other embodiments and modifications thereof are contemplated as falling within the scope of the present invention, as defined by the appended claims.

The invention claimed is:

1. A modular automobile lift that is arranged in a compact bundle for the purpose of transportation of the modular automobile lift to a lift assembly site, said modular automobile lift including: a pair of spaced apart separate runways for the support of an automobile and a pair of cross beams connected with the respective spaced apart separate runways, wherein the pair of cross beams are further connected to lift columns for lifting the spaced apart separate runways, each cross beam being disposed perpendicular to the pair of spaced apart separate runways, each of the spaced apart separate runways being constructed and arranged in separate runway segments, wherein the separate runway segments are connected together in contiguous and linear series alignment by connecting a mounting member between respective separate runway segments forming a runway, further including a cross beam connector member, wherein each cross beam of the pair of cross beams is constructed and arranged in separate cross beam segments that are connected together, and wherein each cross beam is formed by securing the separate cross beam segments in contiguous and linear series alignment by connecting the connector member between respective separate cross beam segments, wherein the mounting member associated with each runway is comprised of separate elongated channel members, one contacting and bridging across each of opposed sides of the respective runway segments, wherein the separate elongated channel members include respective inwardly positioned and outwardly positioned channel members, wherein each channel member comprises a U-shaped channel member with an opening of each channel member resting against respective opposed sides of the runway segments, and further including a first set of fasteners for securing each of the U-shaped channel members between adjacently disposed runway segments so that the runway segments form a continuous runway.

2. The modular automobile lift of claim 1 wherein each separate runway segment extends longitudinally having a length greater than its width.

3. The modular automobile lift of claim 2 wherein the number of separate runway segments is at least two.

4. The modular automobile lift of claim 3 wherein the at least two separate runway segments are of substantially the same length.

5. The modular automobile lift of claim 1, wherein the first set of fasteners includes first fasteners that connect one end of the mounting member to one of the runway segments and second fasteners that connect an opposed end of the mounting member to another linearly arranged runway segment.

6. The modular automobile lift of claim 5 wherein each inwardly positioned U-shaped channel member has a channel member lip that extends from a base of the U-shaped channel member and in a direction toward each other.

7. The modular automobile lift of claim 6 wherein each of the opposed runway segments has an edge lip and wherein opposed runway segments have their edge lips in facing relationship.

8. The modular automobile lift of claim 7 wherein the channel member lip on the mounting is contiguous with the edge lip on the runway segments.

9. The modular automobile lift of claim 8 wherein the edge lip of the runway segments has a recess into which the mounting member is fitted.

10. The modular automobile lift of claim 9 including a second set of fasteners for securing the connector member between adjacently disposed cross beam segments so that the cross beam segments form a continuous cross beam, said second set of fasteners including third fasteners that connect one end of the connector member to one of the cross beam segments and fourth fasteners that connect an opposed end of the connector member to another linearly arranged cross beam segment.

11. The modular automobile lift of claim 10 wherein the connector member comprises a solid rectangular bar and each cross beam is hollow in order to receive opposed ends of the solid rectangular bar, wherein each runway segment has a sidewall with an extending edge lip having a longitudinal recess in which the mounting member sits.

* * * * *